United States Patent [19]

Huperz et al.

[11] 4,328,778

[45] May 11, 1982

[54] DEVICE FOR CONTROLLING A DIESEL MOTOR DRIVEN PUMP DRIVE

[75] Inventors: Adalbert Huperz, Hockenheim; Wolfgang Maasberg, Hünxe-Krudenburg, both of Fed. Rep. of Germany

[73] Assignee: Woma-Apparatebau Wolfgang Maasberg & Co. GmbH, Fed. Rep. of Germany

[21] Appl. No.: 136,768

[22] Filed: Apr. 3, 1980

[30] Foreign Application Priority Data

Apr. 3, 1979 [DE] Fed. Rep. of Germany ..... 2913230

[51] Int. Cl.[3] ..... F02D 7/00; F02M 41/00; F02D 29/04

[52] U.S. Cl. ..... 123/385; 123/387

[58] Field of Search ..... 123/385, 386, 387

[56] References Cited

U.S. PATENT DOCUMENTS 2,445,113 7/1948 Green et al. ..... 123/387

2,675,795 4/1954 Links ..... 123/385

FOREIGN PATENT DOCUMENTS 1279418 12/1962 Fed. Rep. of Germany ..... 123/385

*Primary Examiner*—Wendell E. Burns

*Attorney, Agent, or Firm*—McGlew and Tuttle

[57] ABSTRACT

A device for regulating a diesel motor driven feed pump which includes an injection pump associated with the diesel motor to control its operating speed, comprises a load, a variable pressure resistance connected by a feed line in series in series to the feed pump and a sump for the feed pump connected to the pressure resistance. In addition a control circuit is connected to the feed line and it includes a pressure scale portion and a limiting device portion each of which includes a respective pressure scale cylinder and limiting device cylinder portion for their respective coaxially arranged pressure scale piston and limiting piston slidable therein. A differential manometer is connected between the pressure scale portion and the limiting portion and it is admitted with the flow medium of respective differential pressures of the associated cylinders of these portions. A regulating drive is connected to the flow medium and it is admitted by the respective differential pressure between the two cylinders and it is connected to the injection pump to vary the operation of the pump.

12 Claims, 5 Drawing Figures

DEVICE FOR CONTROLLING A DIESEL MOTOR DRIVEN PUMP DRIVE

FIELD AND BACKGROUND OF THE INVENTION

The invention relates in general to diesel motors and in particular to a new and useful device for controlling a diesel motor driven pump drive with injection pump and feed pump, a feed line leading from the feed pump to a load and a pressure resistance behind the load, and, if necessary, a return line leading back to the sump of the feed pump.

According to the principle of energy conservation, each compound system must give off an amount of energy corresponding to the energy input. If the power input is greater than the power output, the balance is converted to thermal power. In a pump drive comprising an injection pump, diesel motor and feed pump, the residual energy to be converted to thermal power appears when excess flow medium under pressure is conducted over a resistance, e.g. a pressure resistance, and is expanded. The heat released in this process is lost to the atmosphere. If the load power is zero, the entire feed pump power is converted to thermal power and is released into the atmosphere as liberated heat. This results in excess energy expenditure, consumption of flow medium, and wear on the pressure resistance. If the thermal power is to be zero, which is the principal goal, the power input of the feed pump must be equal to the required and actual load output.

SUMMARY OF THE INVENTION

The invention provides a device for controlling a diesel motor driven pump which makes it possible to adapt the instantaneous feed pump power constantly to the actual load power, so that the compound system works with a minimum of energy expenditure, consumption of flow medium, and wear.

According to the invention, a control circuit for the diesel motor with the injection pump provides a primary control element, and a servo motor comprising a pressure scale and a differential pressure-dependent limiting device for a pressure scale is connected to the feed pipe with the interposition of a differential manometer, and the pressure scale and the limiting device are admitted by the flow medium with different pressures. The pressure scale acts over a regulating drive on the final control element and the injection pump. These measures of the invention have the result that the pump delivery is regulated. To this end the feed current is constantly monitored in dependence on the required pressure and consumption. The speed of the feed pump is adjusted in dependence on the indicated feed current, on the pressure resistance, and the respective system pressure. Assigned to the pressure scale is a limiting device, so that the deflection path of the pressure scale is reduced in analogy to the rise in the system pressure when the pump pressure is increased. This reduction of the deflection path serves to maintain the required torque and the required minimum speed on the diesel motor. The regulating drive permits tuning between the servo motor, the injection pump, and the differential manometer.

The pressure scale has a cylinder piston arrangement admitted with flow medium from the feed current before it enters the differential manometer. The manometer has a servo-piston which is connected over a linkage with the regulating drive and it is loaded by a spring, e.g. a tension spring, against the direction of flow medium admission in the direction full feed of the injection pump. Since the pressure scale acts by its spring-loaded servo-piston in the direction load power, so that the compound system works with a minimum of energy expenditure, consumption of flow medium, and wear.

According to the invention, a control circuit for the diesel motor with the injection pump provides a primary control element, and a servo motor comprising a pressure scale and a differential pressure-dependent limiting device for a pressure scale is connected to the feed pipe, and the pressure scale and the limiting device are admitted by the flow medium with different pressures. The pressure scale acts over a regulating drive on the final control element and the injection pump. These measures of the invention have the result that the pump delivery is regulated. To this end the feed current is constantly monitored in dependence on the required pressure and consumption. The speed of the feed pump is adjusted in dependence on the indicated feed current, on the pressure resistance, and the respective system pressure. Assigned to the pressure scale is a limiting device, so that the deflection path of the pressure scale is reduced in analogy to the rise in the system pressure when the pump pressure is increased. This reduction of the deflection path serves to maintain the required torque and the required minimum speed on the diesel motor. The regulating drive permits tuning between the servo motor, the injection pump, and the differential manometer.

The pressure scale has a cylinder piston arrangement admitted with flow medium from the feed current before it enters the differential manometer. The manometer has a servo-piston which is connected over a linkage with the regulating drive and it is loaded by a spring, e.g. a tension spring, against the direction of flow medium admission in the direction full feed of the injection pump. Since the pressure scale acts by its spring-loaded servo-piston in the direction full feed of the injection pump, a controlling force is applied against this spring by the pressure difference in the feed current. This results in a corresponding deflection on the pressure scale. Furthermore, the invention teaches that the limiting device has a cylinder-piston arrangement admitted with flow medium before or after it issues from the differential manometer. The device has a limiting piston which acts coaxially against the servo-piston of the pressure scale and against its flow medium admission by a spring, e.g. a tension spring. The limiting piston forms a load-dependent deflection for the servo-piston, in order to reduce the piston stroke, and thus the deflection path of the pressure scale. This ensures adjustment of the injection pump, which in turn ensures a given minimum speed of the diesel motor. According to the invention, the limiting piston is designed as a differential piston, and has a central bore extending over its length. The limiting piston thus takes over a throttling function, which results in a given damping behavior of the control circuit. The output quantity on the pressure scale, which is proportional to the input quantity, is delayed corresponding to the time constants relative to the input quantity. Preferably the springs for the servo-piston and the limiting piston are replaceable and arranged on the respective cylinders of the two pistons with adjustable initial stress, and they are connected over a yoke with the servo-piston or limiting piston. In this way the optimum differential forces can be fixed on the pressure scale by selecting a suitable tension spring or the number of its resilient turns, taking into account a corresponding adjustment. Consequently the spring constant and the natural frequency can be fixed in the control circuit. The limiting device too can be set in dependence on the hydraulic nominal pressure, e.g. by using different compression springs and consequently variation of the spring characteristic. Besides, spring adjustment is possible by setting the respective compression springs. In this way a sufficient fuel supply is always achieved, to maintain the minimum speed, while ensuring the torque which is established over the injection pump in dependence on the feed pressure of the feed pump on the diesel motor. Besides, the invention provides that the regulating drive has a pivotally mounted adjusting lever with a variation lever length and a Bowden cable connected to the adjusting lever which leads to the final control element and the injection pump respectively. The adjustable drive permits setting of the respective optimum transmission ratio between the servo motor and the injection pump. Consequently the ratio regulating distance servo motor to regulating distance injection pump can be optimized. Adaptation of the servomotor to any injection pump of any type is possible.

The differential manometer can be inserted into the feed pipe between the pressure resistance and the load, whereby a measuring line branching off between the differential manometer and the load, hence ahead of the differential manometer, leads to the pressure scale, and a measuring line branching off between the pressure resistance and the differential manometer, hence behind the differential manometer, leads to the limiting device. Preferably the bypass with a pressure relief valve is assigned to the differential manometer. In combination with the limiting piston of the limiting device designed as a differential piston with central bore, a return into the measuring line system is thus possible, which may cause in extreme cases not only a signal reduction, but also a counter signal over the servo/motor. A signal displaced by 180 degrees on the servo motor opposite to the original controlling force avoids instability. The differential manometer itself can be designed as a restrictor. The pressure resistance is preferably designed as an infinitely variable overflow valve. But it is also possible to arrange the pressure resistance ahead of the differential manometer, one measuring line leading to the pressure scale branched off between the pressure resistance and the differential manometer, and the other measuring line leading to the limiting device branched off ahead of the pressure resistance and the load respectively.

The advantages achieved by the invention consist substantially in that a device for regulating a diesel motor driven pump drive is provided which ensures that the instantaneous output of the feed pump is continuously adjusted to the actual consumption. The compound system comprising the injection pump, diesel motor, feed pump and load thus works with optimum efficiency, that is, with minimum energy expenditure, consumption of flow medium, and wear. Beyond that, the regulating device according to the invention requires no electrical control circuit, because the invention has recognized that the injection pump acting as a final control element requires only small controlling forces. Consequently an increase of the controlling forces by means of an electrical control circuit is not necessary. The regulating device according to the invention is thus also suitable for use in explosion-proof systems. On the whole, the regulating device according to the invention permits optimum regulation of a diesel motor-driven pump drive.

Accordingly the invention provides a device for regulating a diesel motor drive feed pump having an injector pump associated with the diesel for controlling its operation which comprises a load, a variable pressure resistance and a feed line connected in series from the feed pump to the load and the variable resistance and a control circuit connected to the feed line which includes a pressure scale portion and a limiting device portion each including a respective pressure scale cylinder and limiting device cylinder portion and a respective coaxially arranged pressure scale piston and limiting piston slidable therein and further including a differential manometer connected between the respective cylinders of these portions which are admitted with the flow medium of the respective differential pressures and a regulating drive connected to the respective cylinders and admitted by the respective differential pressures between them to vary the operation of the injector pump, A further object of the invention is to provide a device for regulating the diesel motor driven feed pump which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
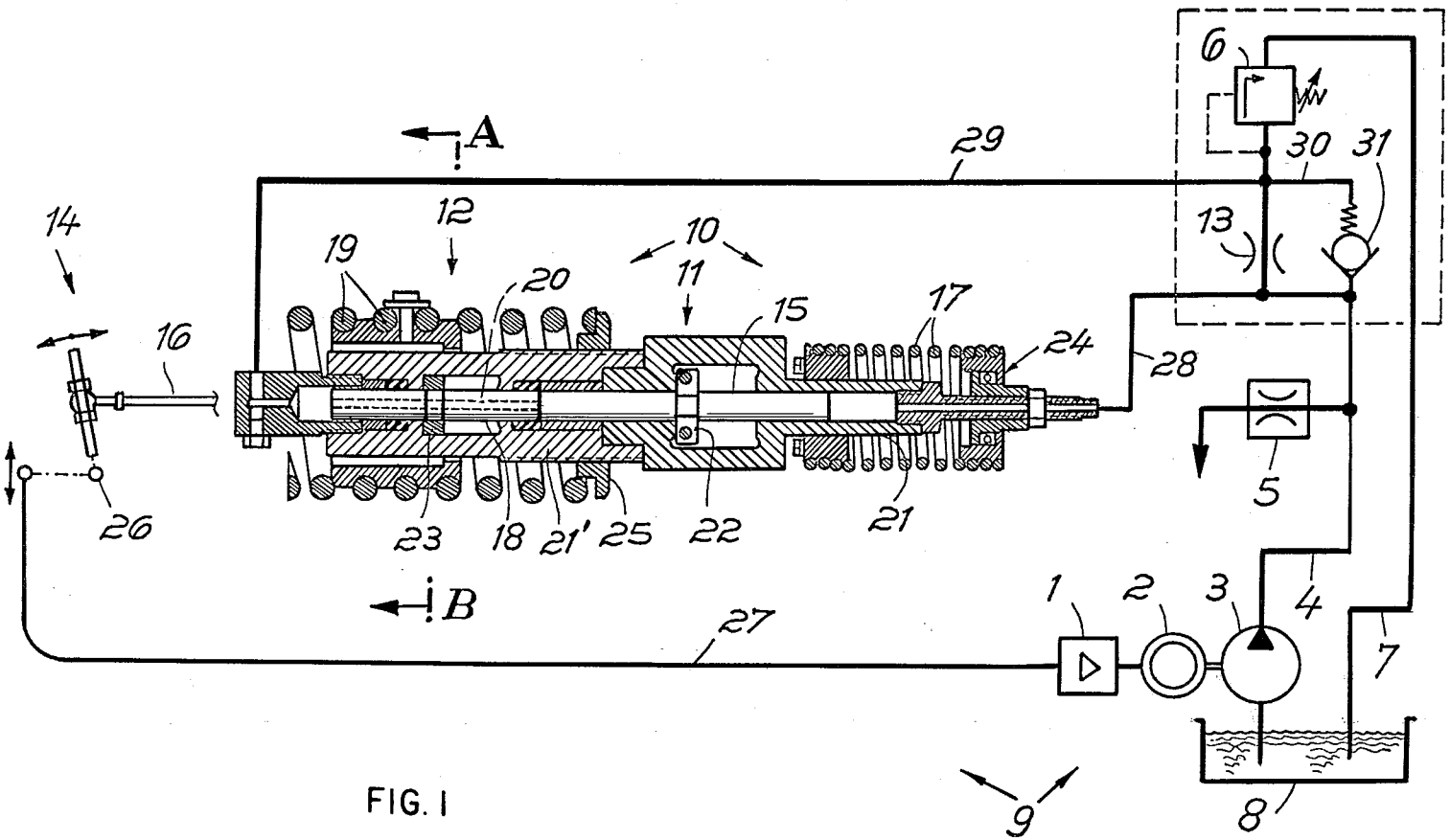
FIG. 1 is a schematic diagrammatical view of a device for regulating a diesel motor driven feed pump constructed in accordance with the invention.
Figure 2:
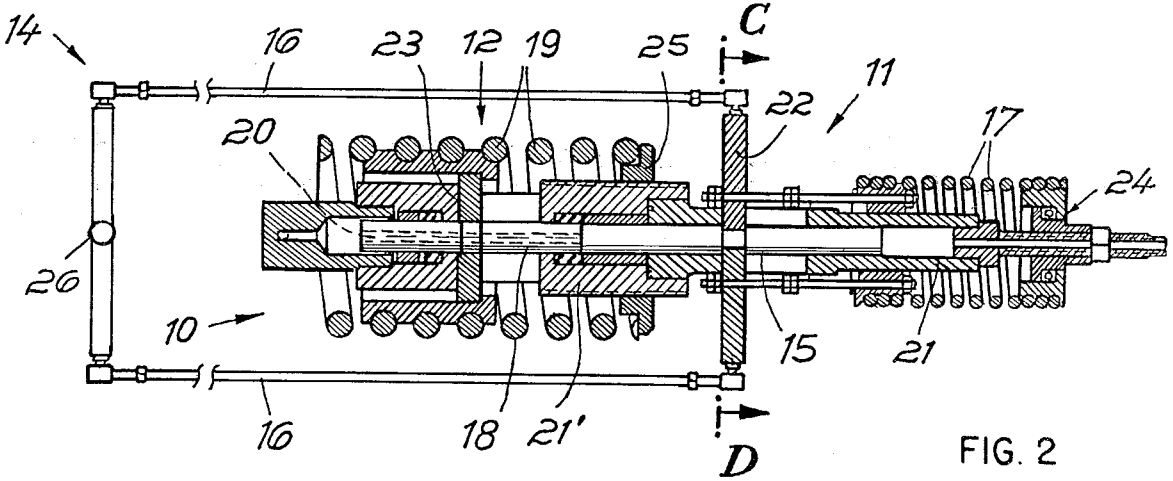
FIG. 2 is a top view of the device shown in FIG. 1.
Figure 4:
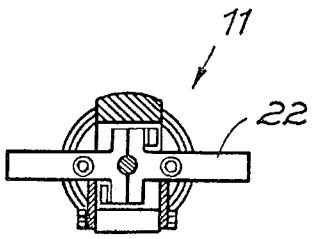
FIG. 4 is a section taken along the line C–D of FIG. 2.
Figure 3:
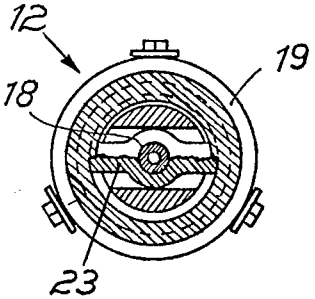
FIG. 3 is a section taken along the line A–B of FIG. 1.

Referring to the drawings in particular the invention embodied therein comprises a device for regulating a diesel-motor driven feed pump 3 which includes a diesel engine 2 having an injection pump 1 or other control device for controlling its operating speed and output. In accordance with the invention a feed line 4 connects to a load 5 and a pressure resistance 6 and a return line 7 connects from the pressure resistance back to a sump 8 for the pump 3. Also connected to the feed line is a servo motor 10 which includes a scale portion 11 and a pressure dependent limiting device portion 12 having respective cylinders 21 and 21' which are connected at respective opposite ends to a differential pressure manometer 13 and to the feed line 4. The differential pressures in the two cylinder portions 21' and 21 are used to regulate a regulator 14 which is connected by a connecting cable 27 to the injector pump in order to vary the operation of the diesel motor 2.

The figures show a device for regulating a diesel motor driven pump drive with an injection pump 1, a diesel motor 2 and a feed pump 3. A feed pipe 4 leads from feed pump 3 to a load 5 followed by a pressure resistance 6. Behind pressure resistance 6, a return line 7 leads back to a sump 8 of the feed pump 3.

Connected to the feed pump 3 is a control circuit generally designated 9 for the diesel motor 2 with the injection pump 1 as a final control element along with a servomotor generally designated 10. The servo-motor comprises a pressure scale portion 11 and differential pressure-dependent limiting device portion 12 for the pressure scale 11. The pressure scale 11 and the limiting device 12, with the interposition of a differential manometer 13 therebetween, are admitted by the flow medium with different pressures. Pressure scale 11 acts over a regulating device 14 on the primary control element, i.e. the injection pump 1.

Pressure scale 11 has a cylinder piston arrangement admitted with a flow medium from the feed current from the feed pump 3 upstream of differential manometer 13. A servo-piston 15 of the scale 11 is connected over a linkage 16 with the regulating drive 14. The piston 15 is loaded, against its flow medium pressure in the direction full feed of injection pump 1 by a spring 17, e.g. a tension spring. The limiting device 12 has a cylinder piston arrangement pressurized with flow medium either upstream or downstream of differential manometer 13, and it has a limiting piston 18 which works coaxially against the servo piston 15 of pressure scale 11 and against its flow medium pressurization due to a spring 19, e.g. a compression spring. Limiting piston 18 can be designed as a differential piston and have a central bore extending over its length for damping purposes. Springs 17 and 19 for servo-piston 15, and limiting piston 18, respectively, are replaceable and arranged with adjustable initial stress on the respective cylinders 21 and 21' of the two pistons, and are connected through a yoke 22 and a yoke 23 with the servo piston 15 and the limiting piston 18 respectively. Beyond that, the number of resilient turns can be adjusted by means of an adjustable thread core 24 and 25.

The regulating drive 14 has a pivotally mounted adjusting lever 26 with a variable lever length, and a Bowden cable 27 connected to the adjusting lever 26, which leads to the final control element or injection pump 1. Regulating device 14 can thus be easily adjusted to the requirements of the respective injection pump used.

The differential manometer 13 is inserted according to one embodiment (FIGS. 1 to 4) between the pressure resistance 6 and load 5 into feed pipe 4. A measuring line 28 branches off between the differential manometer 13 and the load 5 and leads to the pressure scale 11, and a measuring line 29 branches off between the pressure resistance 6 and and the differential manometer 13 leading to limiting device 12. The differential manometer 13 is connected to a bypass 30 with pressure relief valve 31, which limits the maximum differential pressure. The differential manometer 13 is designed as a restrictor, and the pressure resistance 6 is designed as a sensitive, infinitely variable pressure relief valve.

The servo motor 10 comprising the pressure scale 11 and the limiting device 12 permits the superimposition of the functions of torque monitoring and feed current monitoring in dependence on the required pressure and consumption.

Figure 5:
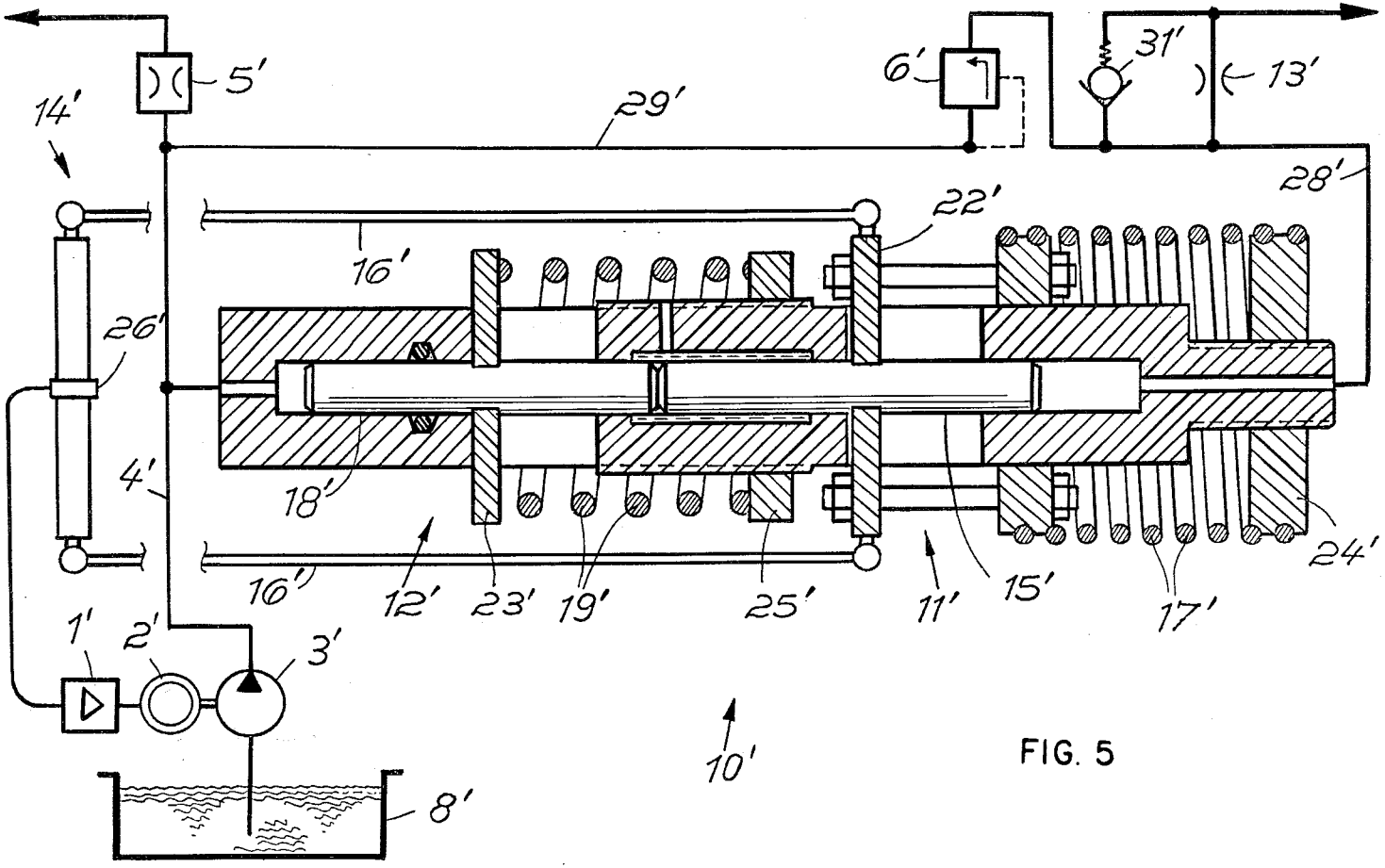
FIG. 5 is a view similar to FIG. 1 of another embodiment of the invention.

According to the modified embodiment of FIG. 5, it is possible to arrange pressure resistance 6' upstream of a differential manometer 13' and to branch off measuring line 28' leading to a pressure scale 11' between pressure resistance 6' and differential manometer 13', while the other measuring line 29' leading to limiting device 12' is branched off ahead of pressure resistance 6' and load 5' respectively. In this case limiting piston 18' is neither designed as a differential piston nor provided with a central bore.

The flow medium conveyed by the compound system injection pump 1', diesel motor 2' and feed pump 3' arrives in a load 5'. At the same time, pressure resistance 6' is admitted over differential manometer 13' by the pressure prevailing in the flow medium. After the predetermined pressure has been attained on pressure resistance 6', the flow medium beings to flow. This leads to the formation of a pressure difference on differential manometer 13', the size of the pressure difference being determined by the rate of flow. The pressure distance is determined over the two measuring lines 28' and 29' and fed to pressure scale 11' of the servo-motor 10'. Pressure scale 11' is so designed that its servo piston 15' acts under the influence of its tension spring 17' in the direction full feed of injection pump 1', and a controlling force is expended against tension spring 17' by the pressure scale 11'.

The deflection path is shortened by the limiting device 12' in analogy to the rise in the system pressure and increase of the feed pump pressure respectively so that the amount of fuel suffices to maintain the required torque and the minimum speed on diesel motor 2'.

While the specific embodiments of the invention have been shown and described in detail to illustrate the application of the principles of the invention, it will be understood that the invention may be embodied otherwise without departing from such principles.

What is claimed is:

1. A device for regulating a diesel motor driven feed pump drive which includes a feed pump, a diesel motor, an injection pump associated with the diesel motor to control its operating characteristics, comprising a load, a variable resistance, a feed line connected in series from the feed pump to said load and to said variable pressure resistance, a sump for the feed pump connected to said variable resistance and said feed pump, and a control circuit connected to said feed line including a pressure scale portion and a pressure limiting device portion, a differential pressure manometer connected between said pressure scale portion and said pressure limiting device portion so that said pressure scale portion and said pressure limiting device portion are subjected to the flow medium at respective differential pressures, a regulating drive connected to said pressure scale portion and to the injection pump and subjected to the respective differential pressures to vary the operation of the injection pump.

2. A device according to claim 1, wherein said pressure scale portion includes a cylinder and a servo-piston therein subjected to feed pump pressure upstream of said differential manometer, and a linkage connected to said regulating drive and said servo-piston, means biasing said servo-piston against the fluid pressure direction in the direction of the flow feed of the injection pump.

3. A device according to claim 2, wherein said means biasing said servo-piston comprises a tension spring.

4. A device according to claim 3, wherein said pressure limiting device portion includes a cylinder and a pressure limiting piston therein, said pressure limiting cylinder being connected to said manometer, said pressure limiting piston being movable so that it acts in a coaxial direction against said servo-piston in said pressure scale portion cylinder and further comprising a compression spring acting on said pressure limiting piston in a direction against its flow medium pressure admission.

5. A device according to claim 4, wherein said pressure limiting piston comprises a differential piston having a central bore extending over its length.

6. A device according to claim 5, wherein said tension spring and said compression spring each have adjustable spring forces, and a first yoke interconnecting said servo piston with said pressure scale portion cylinder and a second yoke interconnecting said pressure limiting piston with said pressure limiting device portion cylinder.

7. A device according to claim 1, wherein said regulating drive comprises a lever pivotally mounted adjacent said control circuit and means interconnecting said lever to the injection pump.

8. A device according to claim 1, wherein said manometer is connected between said pressure resistance and said load to said feed line.

9. A device according to claim 8, including a bypass connected around said manometer and a pressure relief valve in said bypass.

10. A device according to claim 1, wherein said manometer comprises a restrictor.

11. A device according to claim 1, wherein said pressure resistance comprises an infinitely variable pressure relief valve.

12. A device according to claim 1, wherein said pressure resistance is upstream of said differential manometer and including a measuring line leading to said pressure scale portion branching off between said pressure resistance and said differential manometer and a second measuring line leading to said limiting device branching off upstream of said pressure resistance and said load.

* * * * *